US008910411B1

(12) United States Patent
Calvert

(10) Patent No.: US 8,910,411 B1
(45) Date of Patent: Dec. 16, 2014

(54) SUPPLEMENTAL PROJECTILE FOR A FIREARM

(71) Applicant: SPF Associates, Trustee for Supplemental projectile for a firearm CRT Trust, Manassas, VA (US)

(72) Inventor: S. Mill Calvert, Manassas, VA (US)

(73) Assignee: SPF Associates, Trustee for Supplemental projectile for a firearm CRT Trust, Manassas, VA (US)

( * ) Notice: Subject to any disclaimer, the term of this patent is extended or adjusted under 35 U.S.C. 154(b) by 43 days.

(21) Appl. No.: 14/204,573

(22) Filed: Mar. 11, 2014

(51) Int. Cl.
*F41C 27/06* (2006.01)
*F41C 9/08* (2006.01)

(52) U.S. Cl.
CPC .. *F41C 27/06* (2013.01); *F41C 9/08* (2013.01)
USPC ..... 42/105; 42/51; 102/506

(58) Field of Classification Search
CPC ..... F41C 27/06; F41C 9/08
USPC ..... 42/105, 51; 89/1.3, 1.34; 102/506
See application file for complete search history.

(56) References Cited

U.S. PATENT DOCUMENTS

| | | | | |
|---|---|---|---|---|
| 1,376,119 | A * | 4/1921 | Sheppard | 102/484 |
| 3,307,283 | A | 9/1965 | Cox | |
| 3,690,026 | A | 9/1972 | Rose | |
| 3,826,031 | A | 7/1974 | Gabriels | |
| 3,981,093 | A | 9/1976 | Reed | |
| 4,154,012 | A | 5/1979 | Miller | |
| 4,776,255 | A * | 10/1988 | Smith | 89/1.13 |
| 4,813,333 | A | 3/1989 | Garris et al. | |
| 6,688,032 | B1 | 2/2004 | Gonzalez et al. | |
| 6,725,593 | B1 | 4/2004 | Harris | |
| 2014/0013958 | A1 | 1/2014 | Kravel | |

FOREIGN PATENT DOCUMENTS

| | | |
|---|---|---|
| FR | 523.231 | * 8/1921 |
| GB | 1 253 214 | * 11/1971 |

OTHER PUBLICATIONS

Wikipedia, Grenade launcher, http: //en.wikipedia.org/wiki/Grenade_launcher, downloaded Mar. 5, 2014, last modified on Feb. 5, 2014 at 01:37, Internet publication, United States.

The Editor, Grenades and Firearms: Rifle Grenade, Technology & Development, http: //firearmshistory.blogspot.com/2012/10/grenades-and-firearms-rifle-grenade.html, downloaded Mar. 5, 2014, dated Oct. 15, 2012, Internet publication, United States.

* cited by examiner

*Primary Examiner* — Stephen M Johnson
(74) *Attorney, Agent, or Firm* — Louis Ventre, Jr.

(57) ABSTRACT

An auxiliary projectile for a firearm includes: an exhaust vessel to allow a bullet to pass through it yet capture muzzle blast, a barrel socket to slide onto the barrel of the firearm; and a ring magnet to attach to the end of the barrel. The exhaust vessel has opposed openings at each end to permit the unimpeded passage of the bullet discharged from a regular cartridge for a firearm. The opening nearest the muzzle is a muzzle-end opening and the opposite opening is an exit-end opening where the bullet exits. The barrel socket is attached to the exhaust vessel so as to surround the muzzle-end opening and project outward therefrom. The barrel socket is what slides over the muzzle end of the barrel of the firearm. The ring magnet fits within the barrel socket and is what attaches to the muzzle end of the firearm.

6 Claims, 3 Drawing Sheets

SUPPLEMENTAL PROJECTILE FOR A FIREARM

TECHNICAL FIELD

In the field of ammunition and explosives, a shoot-through projectile is propelled through air using muzzle blast after firing a cartridge with a bullet in a rifle or handgun.

BACKGROUND ART

One of the primary drawbacks of a conventional firearm is that it wastes so much of the explosive force it created in order to propel a bullet out of the barrel with the hope of hitting a target. The majority of this precious motion force and energy is wasted by blowing it out the end of the barrel. The muzzle blast collides with the air mass and creates an ear splitting explosive noise, which can give away a soldier's position. Instead of harnessing the muzzle-blast energy and putting it to work for military and law enforcement purposes, this energy is currently wasted.

Utilization of muzzle blast energy to propel a grenade was practiced beginning in World War I. At first, this required a blank cartridge so that a bullet would not impact and blow up the barrel. Later inventions utilized a "bullet trap" or cup which caught the bullet and transferred its momentum to the grenade.

The French developed the VB grenade, shortened from its full name the "Vivien et Bessiers" shoot-through grenade. This technology also required a special cup adapter enabling its function.

SUMMARY OF INVENTION

An easily-added auxiliary projectile for a firearm includes: an exhaust vessel to allow a bullet to pass through it yet capture muzzle blast, a barrel socket to slide onto the barrel of the firearm; and a ring magnet to attach to the end of the barrel. The exhaust vessel is the container that captures the muzzle blast. The exhaust vessel has opposed openings at each end to permit the unimpeded passage of the bullet discharged from a regular cartridge for a firearm. The opening nearest the muzzle is a muzzle-end opening and the opposite opening is an exit-end opening where the bullet exits. The barrel socket is attached to the exhaust vessel so as to surround the muzzle-end opening and project outward therefrom. The barrel socket is what slides over the muzzle end of the barrel of the firearm. The ring magnet fits within the barrel socket and is what attaches to the muzzle end of the firearm. The exhaust vessel may include baffles that extend from the inner wall of the interior cavity but do not interfere with the passage of the bullet. The barrel socket may have a slot so that the barrel socket can easily slide on the barrel around the sight. A perforated tube may be included within the exhaust vessel so as to ensure the bullet path into and out of the exhaust vessel, yet permit the muzzle blast to reach the inner walls of the exhaust vessel.

Technical Problem

There is currently no muzzle attachment for a handgun or a rifle that can be instantly added to the barrel to provide an auxiliary projectile propelled by the muzzle blast from an ordinary cartridge. Speed of attachment is important for practical usefulness and no existing muzzle-blast technology is quickly attached.

There is no such instantaneously-added shoot-through projectile available and especially none that functions without interfering with the flight of the bullet when an ordinary cartridge is discharged in a firearm.

There is no such shoot-through projectile that answers the question of how muzzle blast energy can be easily harnessed and put to work instead of being wasted.

Solution to Problem

The answer to this question has now been solved with the invention of the "supplemental projectile for a firearm." With the supplemental projectile for a firearm, a soldier or law enforcement officer now has a whole line of additional tools to perform his mission and come back home safe.

The supplemental projectile for a firearm is a payload-type projectile that magnetically attaches to the tip of a metal gun barrel in a second or less.

Advantageous Effects of Invention

When the bullet is fired, it passes unobstructed through the holes in the supplemental projectile for a firearm. After the bullet passes through, the majority of the explosive expulsion force is trapped in the supplemental projectile for a firearm and it launches the supplemental projectile for a firearm like a rocket toward the target the bullet was aimed for.

There can be many different types of supplemental projectile for a firearm that a soldier can pick from. For example, there can be: Broad Head knife hole cutters, Chemical agent carriers, RF controlled bombs, incendiary SCHAEFER capsules with buckshot, or sharp cutting grit, etc.

For example, if a Special Forces soldier selected a razor sharp broad head supplemental projectile for a firearm, it could be fired at a terrorist to hit him in the stomach. The rifle bullet would first make its very small hole, but moments later the razor sharp broad head supplemental projectile would make a hole through his body big enough to slide a first through.

The option to instantly add a supplemental projectile for a firearm now puts a whole line of new useful tools and options into the hands of our brave soldiers and law enforcement personnel. This will help to win the war on terror and keep our brave police and soldiers safe.

The old adage of "Waste Not" has been adhered to with the supplemental projectile for a firearm, which now harnesses and uses this wasted muzzle-blast energy to accomplish military and police goals.

BRIEF DESCRIPTION OF DRAWINGS

The drawings illustrate preferred embodiments of the supplemental projectile for a firearm according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
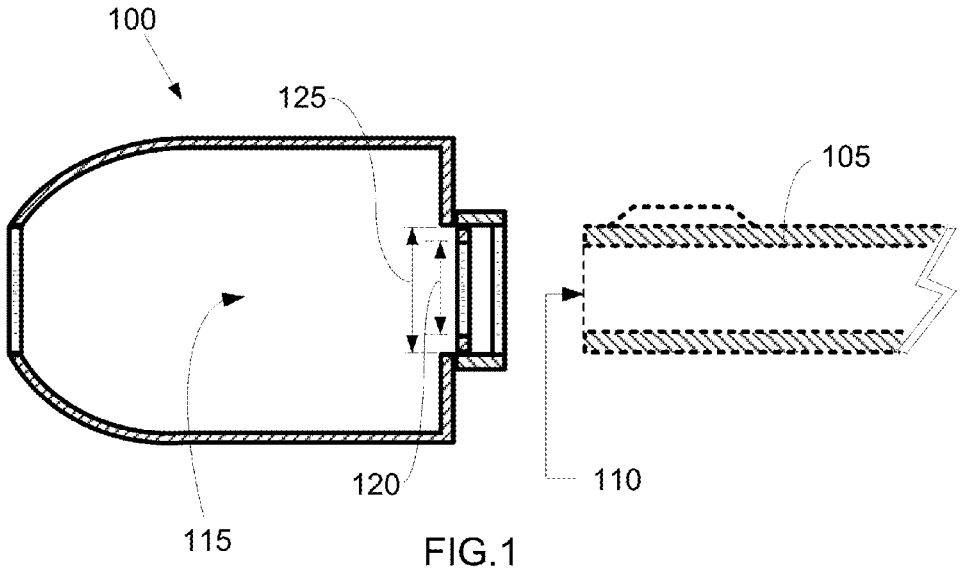
FIG. 1 is a side elevation view of a preferred supplemental projectile alongside the barrel of a firearm.
Figure 3:
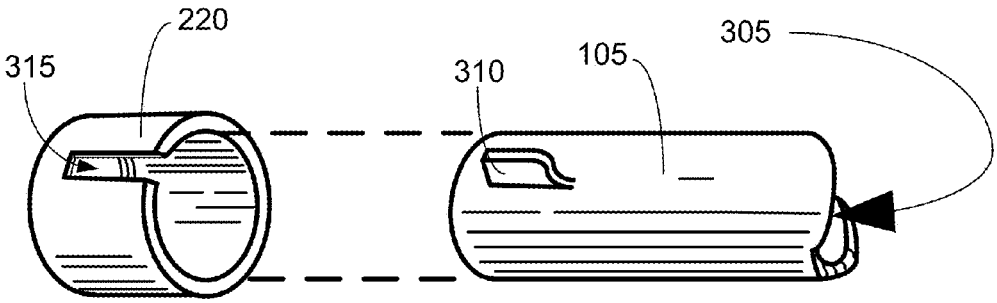
FIG. 3 is a perspective of the barrel socket alongside the barrel of a firearm.

FIG. 1 is a side elevation view of a preferred embodiment of the supplemental projectile (100) for a firearm according to the disclosure herein. The firearm is any pistol, rifle or other portable gun that has at least a barrel (105), a bore (305) and a muzzle (110). It may also have a sight (310) near the muzzle (110), as shown in FIG. 3.

Figure 2:
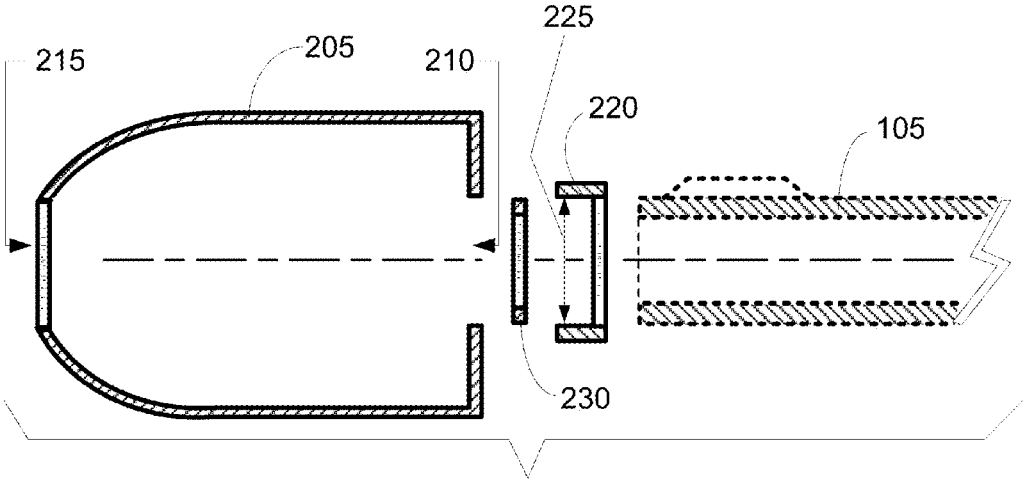
FIG. 2 is an exploded view of the embodiment shown in FIG. 1.

The supplemental projectile (100) includes at least an exhaust vessel (205); a barrel socket (220) and a ring magnet (230), as shown in FIG. 2.

The exhaust vessel (205) is essentially a container defining an interior cavity (115) and having an opening at two ends. The two openings include a muzzle-end opening (210) and an exit-end opening (215). The muzzle-end opening (210) is the opening that is nearest to the muzzle (110) of the firearm and the exit-end opening (215) is the opening where a bullet fired from the firearm exits the supplemental projectile (100).

The muzzle-end opening (210) is larger than the bore (305) of the firearm so that it can accommodate the ring magnet (230) and the ring magnet will not interfere with passage of a bullet fired from the firearm. It is preferable that a discharged bullet will not impact against any part of the supplemental projectile (100) in its path exiting the muzzle (110), entering the barrel socket (220), passing through ring magnet (230), entering the muzzle-end opening (210), passing through the interior cavity (115) and leaving the exit-end opening (215). In this regard, these openings may be round or any other shape.

Preferably, both the muzzle-end opening (210) and the exit-end opening (215) are larger than the bore (305) of the firearm. However, they are not necessarily of the same dimensions. For example, the exit-end opening (215) may be larger in diameter than the muzzle-end opening (210) to accommodate some variation in the flight path of the bullet once it leaves the bore (305) and enters the supplemental projectile (100).

While the exit-end opening (215) will not prevent the muzzle blast from also exiting from this opening, the presence of the exit-end opening (215) will not prevent the supplemental projectile (100) from being propelled forward with the bullet. Part of the reason for this is the presence of the bullet leading the muzzle blast and also the presence of the bullet, although brief, within the exit-end opening (215). Improved efficiency of propulsion of the supplemental projectile (100) may be sought utilizing one or more modifications of the preferred design of the supplemental projectile (100). One or more of such modifications described for any embodiment herein may be combined into a single embodiment.

Figure 4:
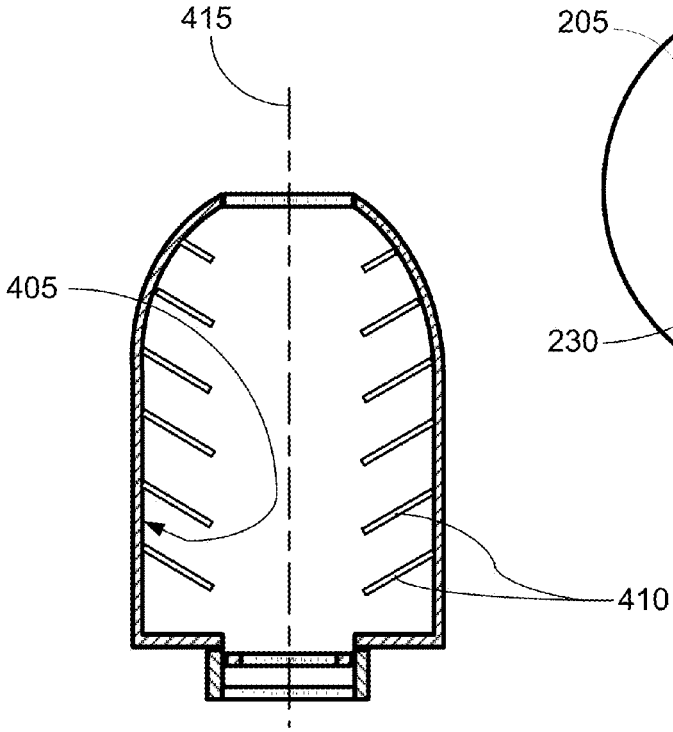
FIG. 4 is an elevation view of an exhaust vessel with baffles extending from its inner wall.

In a first alternative embodiment, illustrated in FIG. 4, the exhaust vessel (205) defines an inner wall (405) around the interior cavity (115), and a plurality of baffles (410) extend from the inner wall (405) of the interior cavity (115) down toward the centerline of the exhaust vessel 205 and preferably above the flight path of the bullet through the supplemental projectile (100). The baffles are preferable angled down toward the muzzle-end opening so as to trap the muzzle-blast exhaust gasses. Preferably, the baffles do not obstruct the anticipated bullet flight path, which would be an extension of the bore (305) through the supplemental projectile (100). Thus, the baffles leave unobstructed a path between the muzzle-end opening (210) and the exit-end opening (215).

Figure 6:
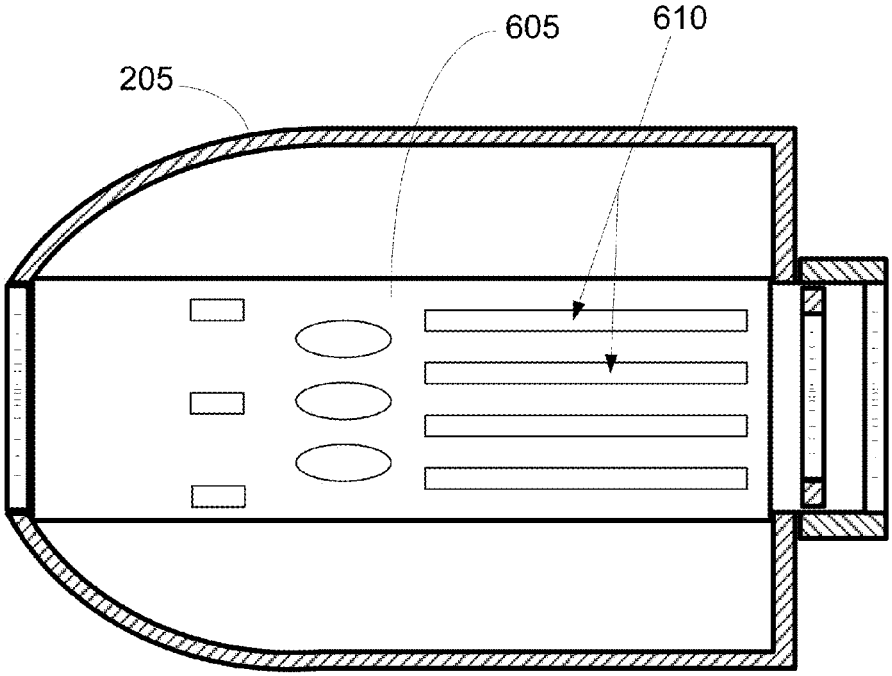
FIG. 6 is a side elevation view of a supplemental projectile with a perforated tube within the exhaust vessel.

In a second alternative embodiment shown in FIG. 6, a perforated tube (605) is added to the exhaust vessel (205) to connect the muzzle-end opening (210) and the exit-end opening (215) so that the bullet path is physically confined to within the perforated tube (605), but the muzzle blast can easily exit the perforated tube (605) within the exhaust vessel (205). Perforations (610) may also decrease in area from the muzzle-end opening (210) to the exit-end opening (215) so that the muzzle blast readily exits the perforated tube (605) immediately after passing the muzzle-end opening (210) and yet is somewhat confined within the exhaust vessel (205) between the inner wall (405) and the perforated tube (605).

Figure 7:
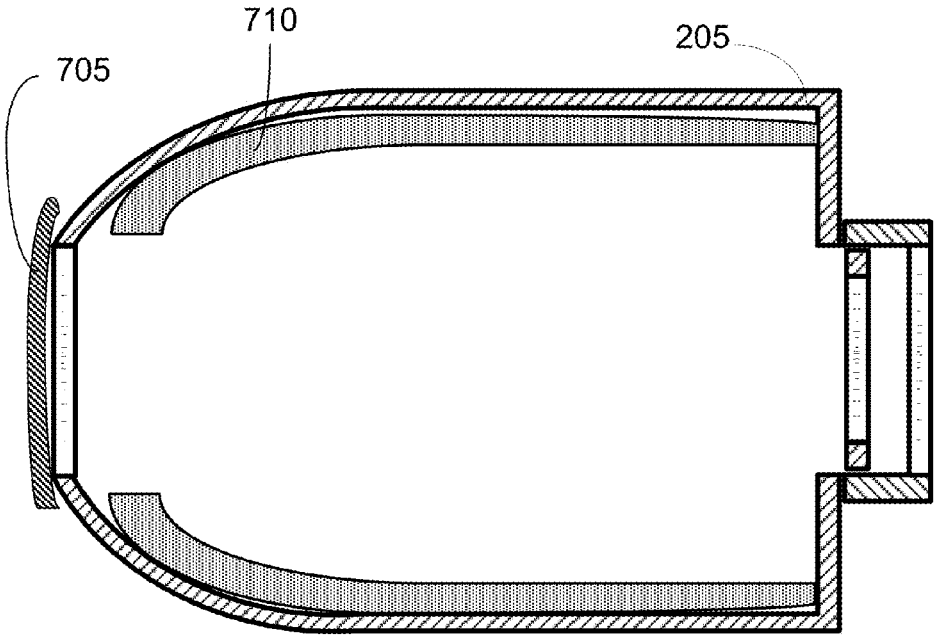
FIG. 7 is a side elevation view of a supplemental projectile with a frangible covering over the exit-end opening of the exhaust vessel and a frangible container within the exhaust vessel.

In a third alternative embodiment shown in FIG. 7, a frangible covering (705) over the exit-end opening (215) permits the bullet to easily rupture it with minimal pass-through resistance, yet preserve the propulsive effect of the muzzle blast for a longer period of time. Preferably, the frangible covering (705) is a thin plastic material.

In a fourth alternative embodiment shown in FIG. 7, a frangible container (710) within the exhaust vessel (205) contains a payload, also referred to as contents, that are releasable upon impact after having been sent to a target. Exemplary payloads or contents are those that can be made to impact or attach to the target, splatter or form an aerosol around the impact area, such as micro radio-frequency markers, a staining paint, a chemical agent, a sleep-inducing vapor, an impact bomb, shrapnel, buckshot, or any other desired payload fitting within the frangible container. In this embodiment, the frangible container (710) is designed to fracture upon impact and release its contents.

The barrel socket (220) is attached to the exhaust vessel (205) so as to surround the muzzle-end opening (210) of the exhaust vessel (205) and project outward from the exhaust vessel (205). Thus, the barrel socket (220) inner diameter (225) is at least as large as the outside diameter of the barrel (105) so that it can be slid on the barrel (105), preferably for a snug fit to minimize loss muzzle blast. A TEFLON coating within the barrel socket (220) helps to minimize wear on the barrel (105) and improve ejection of the supplemental projectile (100).

The ring magnet (230) preferably has an inside diameter (120) larger than the bore (305) of the firearm. This larger inside diameter (120) is so that the ring magnet (230) does not interfere with passage of the bullet through the exhaust vessel (205). The ring magnet (230) preferably has an outer diameter (125) approximately the same as the inner diameter (225) of the barrel socket (220), so that there is a friction fit between the two.

Figure 5:
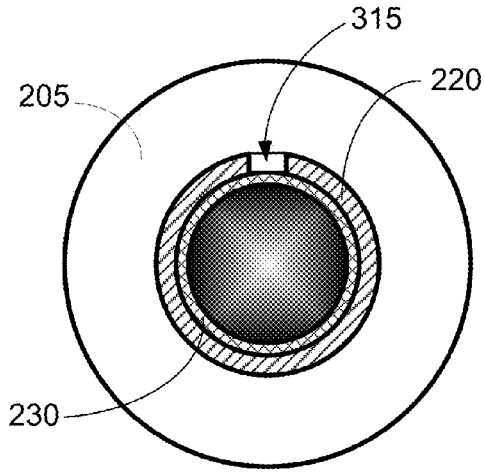
FIG. 5 is an end view of a supplemental projectile including the exhaust vessel, barrel socket, and ring magnet.

The ring magnet (230) is preferably fixed in position within the barrel socket (220) near the muzzle-end opening (210) of the exhaust vessel (205), preferably butted-up against and immediately adjacent thereto. FIG. 5 is an end view of the preferred supplemental projectile (100). FIG. 5 illustrates the location of the exhaust vessel (205), the barrel socket (220), the ring magnet (230) and a slot (315) in the barrel socket (220) to accommodate the sight (310) on a barrel (105). The slot (315) is better shown in perspective in FIG. 3.

In an alternative embodiment, when the firearm comprises a sight (310) on the barrel (105) near the muzzle (110), the barrel socket (220) defines a slot (315) of sufficient dimension to permit the barrel socket (220) to slide onto and off the barrel (105) without interference from the sight (310). Preferably, the slot (315) is wide enough that the sight (310) presents no obstacle to insertion of the barrel socket (220) onto the barrel (105), nor interferes with the ejection of the supplemental projectile (100) when a cartridge in the firearm is discharged. The barrel of some firearms may have a sight (310) that is far enough from the muzzle (110) that a slot (315) is not needed.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A supplemental projectile for a firearm, the firearm comprising a barrel, a bore and a muzzle, the supplemental projectile comprising:

an exhaust vessel defining an interior cavity and having an opening at two ends, the two openings comprising a muzzle-end opening and an exit-end opening, the muzzle-end opening being larger than the bore of the firearm;

a barrel socket attached to the exhaust vessel so as to surround the muzzle-end opening of the exhaust vessel and project outward therefrom, the barrel socket having an inner diameter sufficient to slide over the barrel of the firearm; and a ring magnet having an inside diameter larger than the bore of the firearm and having an outer diameter approximately equal to the inner diameter of the barrel socket, the ring magnet fixed in position within the barrel socket near the muzzle-end opening of the exhaust vessel.

2. The supplemental projectile of claim 1, wherein the exhaust vessel defines an inner wall around the interior cavity, the supplemental projectile further comprising a plurality of baffles extending from the inner wall of the interior cavity and leaving unobstructed a path between the muzzle-end opening and the exit-end opening.

3. The supplemental projectile of claim 1, wherein the firearm further comprises a sight on the barrel near the muzzle, and the barrel socket defines a slot of sufficient dimension to permit the barrel socket to slide onto and off the barrel without interference from the sight.

4. The supplemental projectile of claim 1, further comprising a perforated tube within the exhaust vessel, the perforated tube extending from the muzzle-end opening to the exit-end opening.

5. The supplemental projectile of claim 1, further comprising a frangible covering over the exit-end opening.

6. The supplemental projectile of claim 1, further comprising a frangible container with contents that are releasable upon impact after having been sent to a target.

* * * * *